US006983488B2

(12) United States Patent
Foote et al.

(10) Patent No.: US 6,983,488 B2
(45) Date of Patent: Jan. 10, 2006

(54) EQUESTRIAN HELMET WITH FACEGUARD

(75) Inventors: Frederick C. Foote, Haslett, MI (US); Jon D. Schiff, St. Joseph, MI (US)

(73) Assignee: Foote-Mats, Inc., East Lansing, MI (US)

( * ) Notice: Subject to any disclaimer, the term of this patent is extended or adjusted under 35 U.S.C. 154(b) by 0 days.

(21) Appl. No.: 11/109,614

(22) Filed: Apr. 19, 2005

(65) Prior Publication Data

US 2005/0235402 A1 Oct. 27, 2005

Related U.S. Application Data

(63) Continuation-in-part of application No. 10/829,881, filed on Apr. 22, 2004.

(51) Int. Cl.
*A61F 9/00* (2006.01)

(52) U.S. Cl. ..... 2/10; 2/9; 2/424; 2/425

(58) Field of Classification Search ..... 2/424, 2/425, 421, 422, 410, 411, 10, 9
See application file for complete search history.

(56) References Cited

U.S. PATENT DOCUMENTS

| | | | | |
|---|---|---|---|---|
| 2,867,812 A | | 1/1959 | Roth et al. | |
| 2,892,195 A | | 6/1959 | Monetta | |
| 2,986,739 A | | 6/1961 | Rozzi, Sr. | |
| 3,283,336 A | | 11/1966 | Critser | |
| 3,445,860 A | | 5/1969 | Rodell | |
| 3,790,962 A | * | 2/1974 | Plastino | 2/411 |
| 3,889,296 A | | 6/1975 | Martin | |
| 3,946,442 A | | 3/1976 | Wallander | |
| D243,128 S | | 1/1977 | Morgan | |
| 4,042,974 A | | 8/1977 | Morgan et al. | |
| 4,101,983 A | * | 7/1978 | Dera et al. | 2/412 |
| 4,233,687 A | | 11/1980 | Lancellotti | |
| 4,271,537 A | | 6/1981 | Bowlus et al. | |
| D262,326 S | | 12/1981 | Loonnstedt | |
| 4,587,677 A | * | 5/1986 | Clement | 2/424 |
| 4,713,844 A | | 12/1987 | Westgate | |
| 4,774,729 A | | 10/1988 | Coates et al. | |
| 4,885,807 A | | 12/1989 | Snow, Jr. | |
| 4,947,490 A | | 8/1990 | Hayden | |
| 4,985,938 A | | 1/1991 | Snow, Jr. | |
| 5,093,936 A | | 3/1992 | Copeland et al. | |

(Continued)

FOREIGN PATENT DOCUMENTS

DE 3214020 A1 * 7/1983

(Continued)

OTHER PUBLICATIONS

"Exhibit A—discloses prior art equestrian helmets found at www.victorycanter.com," 5 pgs., published at least prior to Mar. 18, 2004.

(Continued)

*Primary Examiner*—Rodney M. Lindsey
(74) *Attorney, Agent, or Firm*—Price, Heneveld, Cooper, DeWitt & Litton LLP

(57) ABSTRACT

A helmet, such as for equestrian sports, includes an outer shell formed by an upper dome and a lower ring attached to a bottom edge of the upper dome by screws. The assembled arrangement is particularly strong but is adapted to facilitate molding and further has a traditional equestrian helmet appearance. A removable faceguard includes legs shaped to upwardly fit into downwardly-open cavities formed within the ring, and includes latches pivoted to the legs for snap-attachment to lateral surfaces within the cavities. The latches are made of a material optimized for durability and resiliency, and are preferably of a material different than the faceguard itself.

33 Claims, 11 Drawing Sheets

U.S. PATENT DOCUMENTS

| | | | | | |
|---|---|---|---|---|---|
| 5,101,517 | A | * | 4/1992 | Douglas | 2/424 |
| 5,129,108 | A | | 7/1992 | Copeland et al. | |
| D336,552 | S | | 6/1993 | Timms et al. | |
| 5,271,103 | A | * | 12/1993 | Darnell | 2/418 |
| RE34,699 | E | | 8/1994 | Copeland et al. | |
| 5,384,914 | A | | 1/1995 | Caveness et al. | |
| D355,508 | S | | 2/1995 | Tutton et al. | |
| 5,477,565 | A | | 12/1995 | Hunt, Jr. | |
| D366,539 | S | | 1/1996 | Lackovic | |
| D369,441 | S | | 4/1996 | Crestin-Billet | |
| 5,502,843 | A | | 4/1996 | Strickland | |
| 5,517,698 | A | | 5/1996 | Nault et al. | |
| 5,555,567 | A | * | 9/1996 | Corpus | 2/424 |
| 5,555,570 | A | * | 9/1996 | Bay, Jr. | 2/424 |
| 5,571,220 | A | | 11/1996 | Hall | |
| 5,575,018 | A | | 11/1996 | Rothrock | |
| 5,598,588 | A | * | 2/1997 | Lee | 2/421 |
| 5,619,755 | A | | 4/1997 | Casartelli | |
| 5,619,756 | A | * | 4/1997 | Garneau | 2/425 |
| 5,638,551 | A | * | 6/1997 | Lallemand | 2/421 |
| 5,675,875 | A | | 10/1997 | Servatius | |
| 5,713,082 | A | | 2/1998 | Bassette et al. | |
| 5,715,541 | A | | 2/1998 | Landau | |
| 5,718,004 | A | | 2/1998 | Broersma et al. | |
| 5,896,590 | A | | 4/1999 | Fleisch | |
| 5,963,990 | A | | 10/1999 | White | |
| 5,966,744 | A | | 10/1999 | Smith, Jr. | |
| 5,987,652 | A | | 11/1999 | Fowler | |
| 6,047,400 | A | | 4/2000 | Spencer | |
| 6,079,053 | A | * | 6/2000 | Clover et al. | 2/424 |
| 6,085,357 | A | | 7/2000 | Broersma | |
| 6,189,156 | B1 | | 2/2001 | Loiars | |
| 6,257,398 | B1 | | 7/2001 | Lindars | |
| D449,135 | S | | 10/2001 | Martin et al. | |
| D449,713 | S | | 10/2001 | Martin et al. | |
| 6,298,498 | B1 | * | 10/2001 | Burns et al. | 2/424 |
| 6,317,896 | B1 | * | 11/2001 | Timms et al. | 2/417 |
| 6,499,139 | B1 | | 12/2002 | Brown et al. | |
| D476,776 | S | | 7/2003 | Finquel | |
| RE38,246 | E | | 9/2003 | Leonard et al. | |
| 6,892,393 | B1 | | 5/2005 | Provost et al. | |

FOREIGN PATENT DOCUMENTS

| | | | | |
|---|---|---|---|---|
| DE | 3744114 | A1 | | 10/1988 |
| EP | 334773 | A1 | * | 9/1989 |
| FR | 2629986 | A1 | * | 10/1989 |
| GB | 2201330 | A | | 9/1988 |
| WO | WO 8400878 | A1 | * | 3/1984 |

OTHER PUBLICATIONS

"Exhibit B—discloses prior art Bond Street Polo Helmet found at www.horsemall.com", 2 pgs., published at least prior to Feb. 3, 2004.

* cited by examiner

EQUESTRIAN HELMET WITH FACEGUARD

This application is a continuation-in-part of application Ser. No. 10/829,881, filed Apr. 22, 2004, entitled EQUESTRIAN HELMET WITH FACEGUARD, the entire contents of which are incorporated herein by reference.

BACKGROUND

The present invention relates to protective helmets with faceguards, and more particularly relates to an equestrian helmet with removable faceguard and having a novel construction to facilitate assembly and use. It is noted that the present helmet and inventive concepts are believed to be usable in a variety of different circumstances and hence several aspects are believed to be broader in scope than just equestrian helmets.

The equestrian sport of "eventing" has become very popular. Eventing is the equivalent of an "equestrian triathlon" with the rider working with a horse both on the flat and over fences. The three phases are: dressage (the execution by a trained horse of precision movements in response to barely perceptible signals from its rider, somewhat like "show dancing"), endurance (sometimes called "cross-country"), and show jumping. A different level of head protection is needed for the rider in each different event. In dressage, the traditional helmet shape and appearance is very important, since it has become an integral part of the elegant, graceful performance. Contrastingly, in the event of jumping, the rider needs to be protected from a fall but also the rider's face needs to be protected from colliding with the horse's head when jumping since the horse's head and rider's head may move rather violently in opposing directions during a jump. Also, the rider's helmet must not include protruding parts that may strike and injure the horse's head upon collision with the rider's helmet. In the event of cross-country, the raw power and spirit of a horse and the dynamics of other riders and obstructions encountered require that the rider's head be very well protected against a fall, and yet his vision must be totally clear and unobstructed. There are also many other equestrian sports, some where a faceguard is desirable and others where it is not. Finally, in training horses for any of these sports, a faceguard is extremely useful when working with young, inexperienced or sprightly horses that are prone to rearing, bucking or "spooking" (lurching with fear) and endangering the rider's head and face.

Despite this need for head and face protection, faceguards have not been developed or widely accepted for equestrian helmets. The reasons are many and varied. Riders often do not like to keep multiple helmets around, and do not like to (nor have time to) switch helmets during a competition. It is desirable to provide an equestrian helmet with a removable faceguard to solve this problem, but equestrian helmets have requirements that make them unique and that "complicate" this problem. Riders require a wider field of vision than in most sports and, further, they need the ability to turn their head without restriction from the helmet. Also, the helmet must also be sufficiently light in weight and open around the chin and ears so as to not be a hindrance.

Furthermore, in some equestrian sports such as dressage, appearance and style are extremely important. The helmet needs to have a very particular outer shape and appearance, and it is not acceptable to have any bulge or appendage, especially on the sides of the helmet. In particular, it is not acceptable to have any protruding attachment structure, whether the faceguard is attached or not. An outwardly protruding attachment structure on a helmet is not only potentially unsightly to equestrian sportsmen (and judges), but it can also be a safety hazard in terms of its potential for causing injury to the horse and/or rider, or for catching or snagging an obstacle or the ground during a fall. Also, any protruding structure can interfere with (if not ruin) the removable bright fabric covers often placed over equestrian helmets when in a competition. Finally, it would be undesirable if an equestrian helmet with its faceguard removed looked as if it was missing something or otherwise looked imperfect.

More generally, sportsmen do not want to struggle with inserting and/or removing a faceguard. Instead, they would prefer an attachment system that is easy to release and reattach, and an attachment structure that is totally hidden from view. Also, it is desirable to provide a faceguard that provides a very positive engagement, including an audible indication or other positive action that indicates that a secure connection with the helmet has been made. Further, the faceguard must be attractively stylized to combine functional strength with appearance when the faceguard is attached. Removable faceguards even provide riders with the opportunity to swap faceguards made of different colors to match the brightly colored outfits and bright fabric helmet covers common in equestrian competitions.

Thus, a system having the aforementioned advantages and solving the aforementioned problems is desired.

SUMMARY OF THE PRESENT INVENTION

In one aspect of the present invention, a protective helmet includes an impact-resistant outer helmet shell shaped and adapted to partially cover a wearer's head, the shell having an upper dome with a lower edge and having a separate lower rim with an upper surface that mates against the lower edge, the rim being attached to the upper dome.

In another aspect of the present invention, a protective helmet includes an impact-resistant outer helmet shell shaped and adapted to partially cover a wearer's head, the shell having an upper dome with a lower edge and having a separate lower curvilinear structural member with an upper surface that mates against the lower edge. The curvilinear structural member is attached to the upper dome and extends at least completely across a rear of the shell and at least about halfway forward on each side of the shell.

In still another aspect of the present invention, a protective helmet includes an impact-resistant outer helmet shell shaped and adapted to partially cover a wearer's head, the shell defining a lower edge with marginal material defining a pair of cavities along the lower edge. The marginal material at each said cavity defines a downwardly-facing opening for access from below and further defines a laterally-facing opening that extends in a direction perpendicular to the downwardly-facing opening. The cavities are each shaped and adapted to receive an attachment leg of a faceguard so that the attachment leg can be fit upwardly through the downwardly-facing opening and into the cavity, and the laterally-facing opening being shaped and adapted to receive a latch on the leg. By this arrangement, when the leg is fit into the cavity, the latch fits laterally into the laterally-facing opening for retaining the leg in the cavity.

In still another aspect of the present invention, a faceguard is provided for a protective helmet and that is useful when attached to the helmet to help protect a person's chin and head from injury. The faceguard includes an elongated curvilinear component having a transverse section and rearwardly-extending side sections positioned in a U-shaped arrangement that is adapted to extend around the person's head at a height about equal to the person's chin. The component includes attachment legs that extend upwardly from opposing ends of the side sections. A latch member is provided on each of the opposing ends of the side sections. The latch members are each made of a material different from the component and are attached to the opposing ends for movement between a latched position and a latch-released position.

In yet another aspect of the present invention, a protective helmet includes an impact-resistant outer helmet shell shaped and adapted to partially cover a wearer's head, the outer helmet shell having a marginal section of material forming a lower perimeter around the helmet shell and further having a horizontally extending rod-shaped retainer extending horizontally and that is spaced above the marginal section of material forming the lower perimeter. An impact-absorbing foam material is positioned within the outer helmet shell and at least partially covers the rod-shaped retainer. An adjustable suspension is positioned within the helmet shell and is adapted to engage the wearer's head for supporting the helmet shell on the wearer's head while the protective helmet is being worn. The suspension has strap ends attached to the marginal section, with at least one of the strap ends being elongated and forming an adjustable strap that extends over the rod-shaped retainer and then back to a location within the helmet shell that is accessible. By this arrangement, the adjustable strap can be pulled to adjust the suspension and whereby friction between the rod-shaped retainer, the foam material and the adjustable strap retain the adjustable strap in an adjusted position.

It is also an object of the present invention to provide a protective helmet with a faceguard where the faceguard attaches securely and with a robust action to assure that a secure connection has been satisfactorily completed.

It is also an object of the present invention to provide a protective helmet with a faceguard where the faceguard provides a maximum field of vision yet helps protect the person's jaw and face.

It is also an object of the present invention to provide an aesthetic yet functional protective helmet with a faceguard designed to complement the shape of the classic equestrian helmet.

The present invention is believed to include the design and appearance of the present assembly, as well as individual components thereof.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 5:
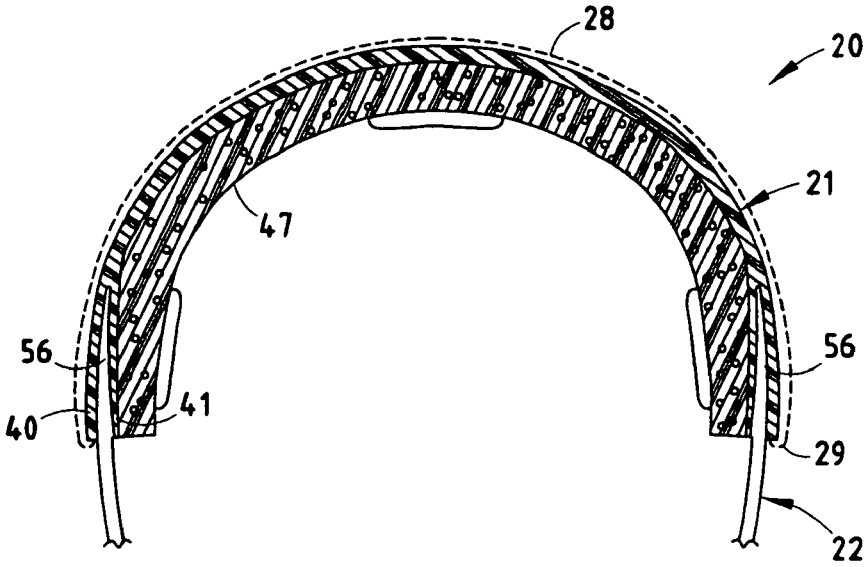
FIG. 5 is a cross section taken along lines V—V in FIG. 3.
Figure 4:
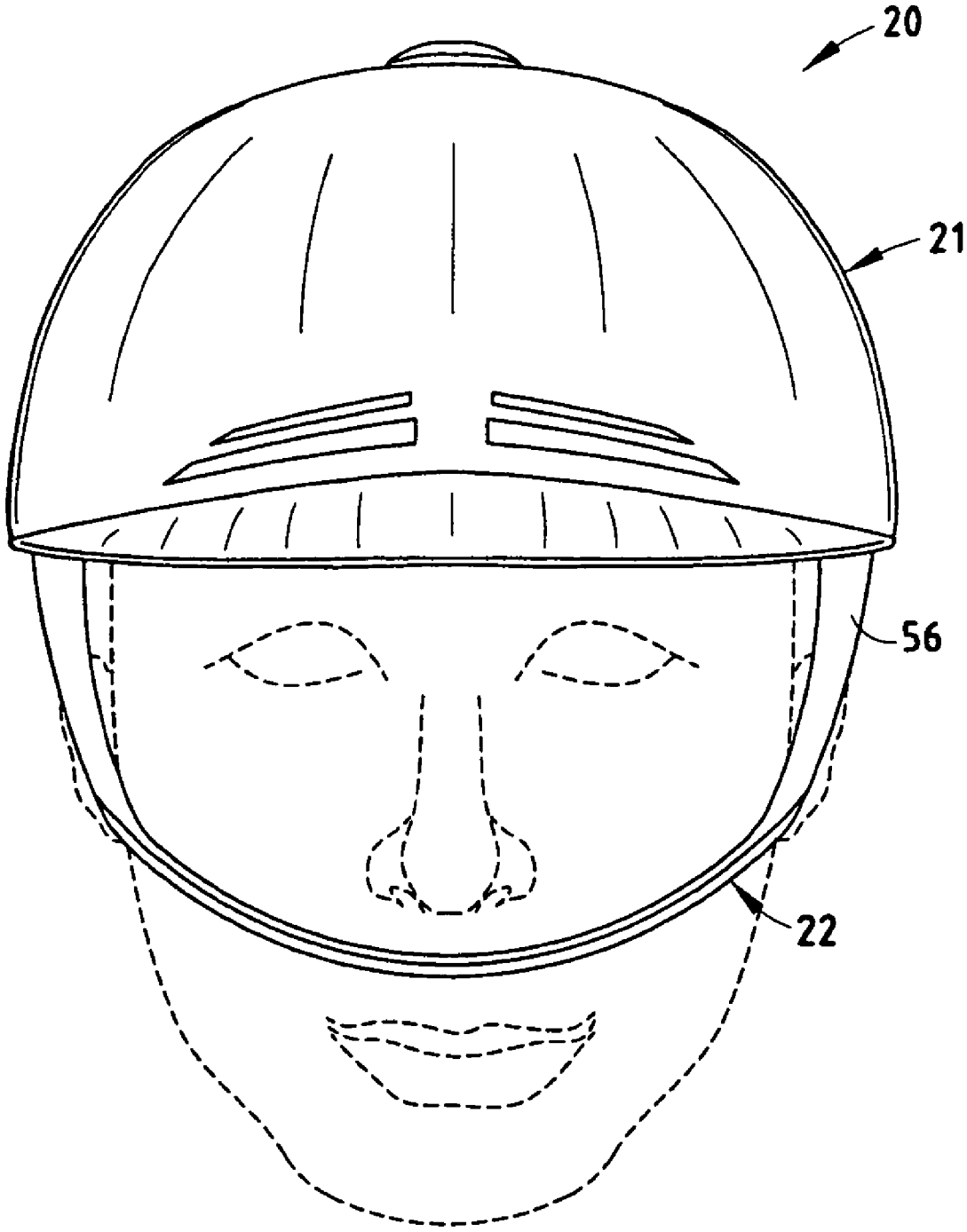
FIG. 4 is a front view of FIG. 1.

A helmet 20 (FIGS. 1–5) is illustrated that is particularly adapted for use in equestrian sports but it is contemplated that it is adapted for use in many other sports and situations where protective head gear is desired that allows a wide unobstructed field of view and where its faceguard may want to be easily and quickly removed. The illustrated helmet 20 (FIG. 3) includes an impact-resistant outer helmet shell 21 and a U-shaped releasably-attached faceguard 22. The shell 21 is formed to cover the upper half and rear of a wearer's head. The shell 21 has an upper dome 23 and also has a lower continuous rim 24 extending around the dome 23. The shell 21 includes a front portion 25, lateral side portions 26, and a rear portion 27, all portions 25–27 having outer surfaces that are relatively smooth, particularly the lateral side portions 26. The reason for this is both aesthetics (i.e., to match the traditional shape of equestrian helmets) and also function (to avoid outward protrusions that can cause safety concerns). Notably in equestrian sports, the appearance is more than just a desire; in higher level competition, it is virtually a requirement as part of the grace and beauty judging that occurs. Accordingly, in some aspects of this design, we consider this feature a physical requirement and not just a visual standard. Also, outward projections would interfere with the attachment of removable bright fabric coverings 28 (FIG. 5) that are often attached in equestrian sports over the shell 21. In particular the fabric coverings 28 can include a brightly colored material with a drawstring or elastic member 29 around its lower perimeter to retain the coverings 28 to the helmet 20. Also, lateral projections are potentially injurious to a horse and/or rider, such as in jumping events where a rider may turn his/her head as the horse's head and rider's helmet abut, such that it is desirable to avoid lateral projections for additional reasons. Finally, it would be undesirable if a helmet with a removable faceguard looked as if it was missing something when the removable faceguard was not being used and was thus removed from the helmet.

Figure 6:
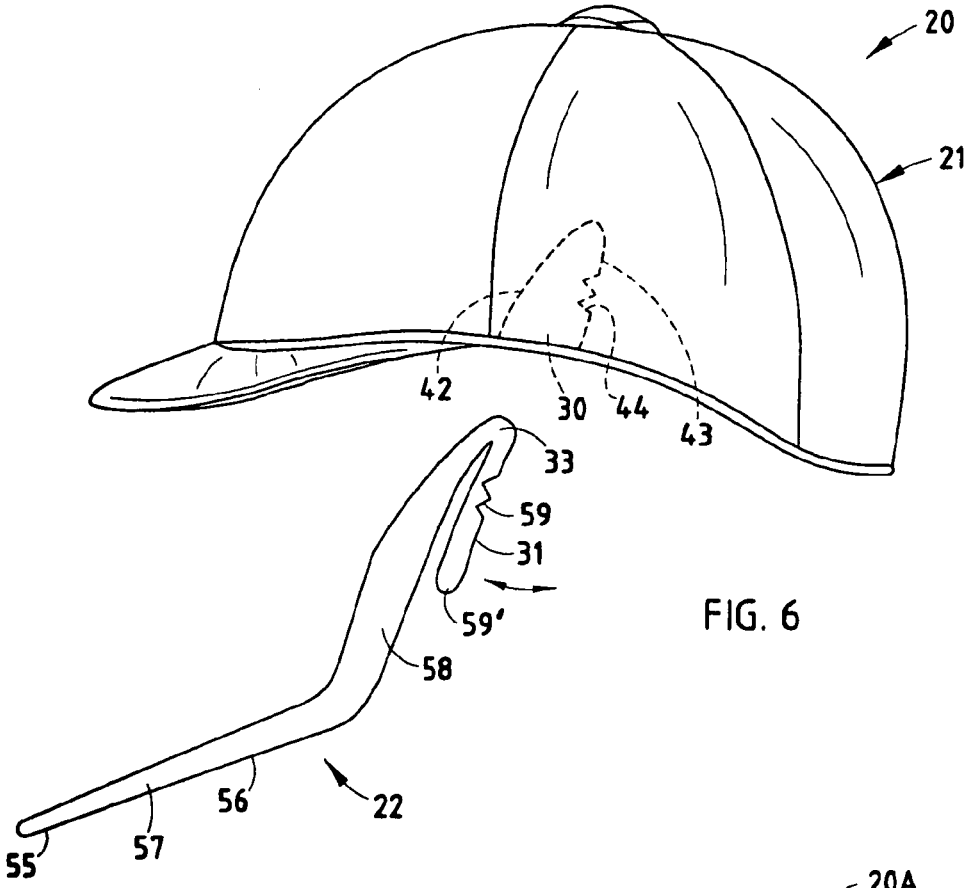
FIG. 6 is an exploded view of FIG. 4.

Inside of the lateral side portions 26 are integrally-formed attachment receptors 30 (FIG. 6) (i.e., shark-tooth-shaped pockets), which are designed to be releasably engaged by the latch members 31 on the rearwardly-extending portions of the faceguard 22, as discussed below. The attachment receptors 30 open downwardly through the rim 24, such that they are not visible from the sides or the front of the helmet 20, which is an important property of the present helmet 20 as discussed above. The latch members 31 are integrally formed and resiliently biased and supported on a tail end (or blade portion) of the rear upright section 58 by a living hinge 33 such that they securely engage the attachment receptors 30 with an audible click. Also, this allows them to be released by a simple pinching motion, allowing them to be quickly and easily released from the helmet 21 with a smooth easy finger motion.

The lateral side portions 26 of the helmet shell 21 (FIG. 5) include an outer wall 40 and inner wall 41 defining the receptor 30 therebetween. The receptor 30 (FIG. 6) has front and rear surfaces 42 and 43 that are angled toward each other. The illustrated surfaces 42 and 43 define a "shark tooth" shape that is conducive to molding since it provides for release of the blade in the molding die that formed the receptor 30. Further the tapered shape of the "shark tooth" receptor allows for easier insertion of the tail end of the upright section 58 and living hinge 33 without a precise alignment prior to insertion. On the rear surface 43 are one or more teeth 44. The illustrated teeth 44 are sufficiently high and perpendicular to the rear surface 43 such that they would require a slide or movable component on the blade of the molding die in order to prevent die lock. However, it is contemplated that there are ways to reduce any need for a movable slide in the molding die such as by tilting and/or shortening the teeth to extend parallel the front surface 42 or by making the teeth into depressions instead of protruding teeth or other ways known in the art of tool-making. It is contemplated that the walls 40–41 and surfaces 42–43 will be integrally molded as part of the helmet shell 21 to provide structural strength and to simplify and reduce costs of the helmet 20, but it is contemplated that the present invention includes other non-integral means of attachment such as an internally-positioned bracket.

A liner 47 (FIG. 5) is positioned inside of the helmet shell 21 for comfortably supporting the helmet shell 21 on a person's head. The illustrated liner 47 is made from expanded polymeric foam material such as expanded polystyrene pellets for optimal energy absorption to minimize any injury to a person's head upon impact. Such liner materials are well known in the industry of helmet manufacture and a detailed description of such is not necessary for an understanding of the present invention. The illustrated liner 47 includes a depression to matingly receive and engage the attachment receptor 30. A chin strap 48 (FIG. 3) is attached to the helmet shell 21 for retaining the helmet 20 to a rider's head. It is contemplated that the present invention will also work with many different liners and a variety of different chin strap arrangements. For example, the present invention will work with the harness-type support as shown in Timms et al. U.S. Pat. No. 6,317,896, the entire contents of which are incorporated herein by reference for the purpose of their teachings. A short visor 49 extends forwardly from the front portion 25 of the helmet shell 21. Also, ventilation apertures such as apertures 50 (FIG. 1) can be integrally formed in the helmet shell 21 such as immediately above the visor where they cause air flow across the rider's head. Other modifications to the helmet shell 21 and liner 47 can be made such as attachment of a top piece 51 to the dome 23.

The faceguard 22 (FIG. 6) is an integrally molded one-piece part having a U-shaped cross bar 55 that extends across the rider's face near his/her nose and mouth and further includes L-shaped arms 56 that extend upwardly. The arms 56 each include a front horizontal section 57 that extends generally horizontally and a rear upright or vertical section 58 that extends generally vertically. By this arrangement, the field of vision, including peripheral vision, is maximized for the rider since the faceguard 22 is positioned well below the person's eyes. (See FIGS. 3–4.) Notably, the cross bar 55 and arms 56 can be made thicker or thinner and to have different optimally-shaped cross sections to resist forces of impact. The illustrated cross section of the upper end of the arms 56 is rather long in a fore-to-aft direction (FIG. 6) for strength against a frontal impact but is relatively thin in a lateral direction (FIG. 5) to provide give and flexure in a lateral direction and to minimize intrusion into the space within the helmet shell 21 for the liner 47 and the rider's head. The portion of the blade as it enters the helmet shell 21 can be enlarged and present a step to resist the blade from acting as a wedge as a force attempts to cause the blade to move into the receptacle in the helmet. Alternatively, depending on material strengths, a step may not be required.

The tail end of the vertical section 58 (FIG. 6) is "blade" shaped and includes a thinned resilient region forming the integral living hinge 33. The latching member 31 extends in a reverse direction parallel the vertical section 58. The latching member 31, in its engaged position, is spaced slightly from the vertical section 58 and is biased outwardly to engage a tooth(s) 59 with the teeth 44 on the rear surface 43 of the receptor 30 of the attachment structure on the helmet shell 21. A lower end of the latching member 31 extends slightly below the rim 24 to form a tab-like handle 59'. By a simple finger action on the handle 59' first in a direction toward the vertical section 58 and then downwardly, the faceguard 22 can be quickly and easily removed. To engage the faceguard 22, the faceguard 22 is manipulated to place the living hinge 33 in the receptor 30, and then it automatically self-aligns as the faceguard 22 is moved upward into position. As the faceguard 22 moves to its fully inserted position, the tooth(s) 59 ramp onto the teeth 44 and then snap into position with an audible click. This is very desirable since it indicates to the rider that the faceguard 22 is fully inserted and locked into position. Also, I've found that the sound provides a feedback of secure connection to the rider that is greatly appreciated.

As noted above, the structure of faceguards (and also the aesthetics) is important in many equestrian sports. The illustrated faceguard 22 provides both. In particular, the flowing lines from the vertical section 58 create symmetry with the strap 48 (FIG. 3) that is believed to be acceptable to riders and judges of equestrian events. The forward section 57 also extends generally parallel the visor 49 in a similarly symmetrical and acceptable fashion. This is believed to be more than mere appearance, though it clearly also has novel, ornamental, and non-obvious distinctiveness, in my opinion.

Upon impact, the illustrated faceguard 22 (FIG. 3) is able to move and flex slightly as indicated by arrow 60. Notably, this action does not cause release of the latching member 31 due to the direction of forces generated in the present arrangement.

Additional embodiments of the present invention are presented below. Features that are similar or identical are identified using the same numbers as previously discussed but with the addition of a letter "A," "B," or "C." This is done for the purpose of reducing redundant discussion.

Figure 3:
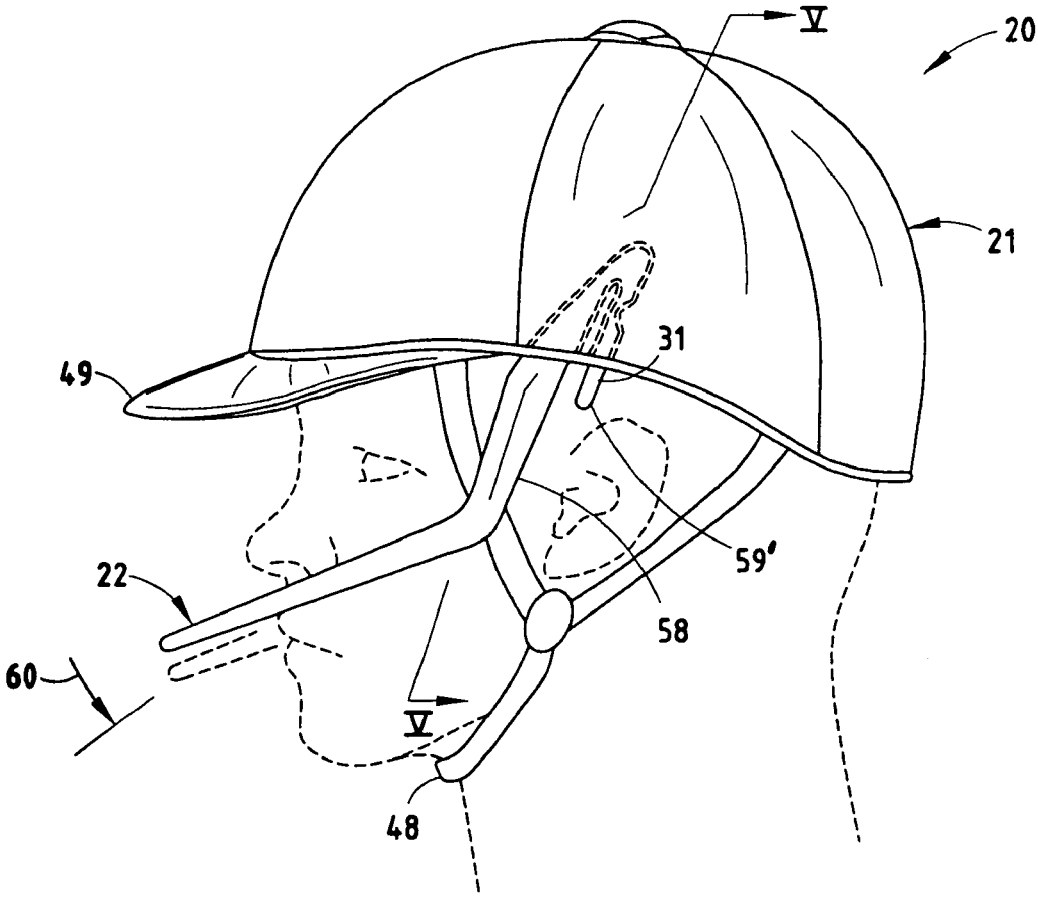
FIG. 3 is a side view of the helmet of FIG. 1, including a chin strap worn by a rider.
Figure 7:
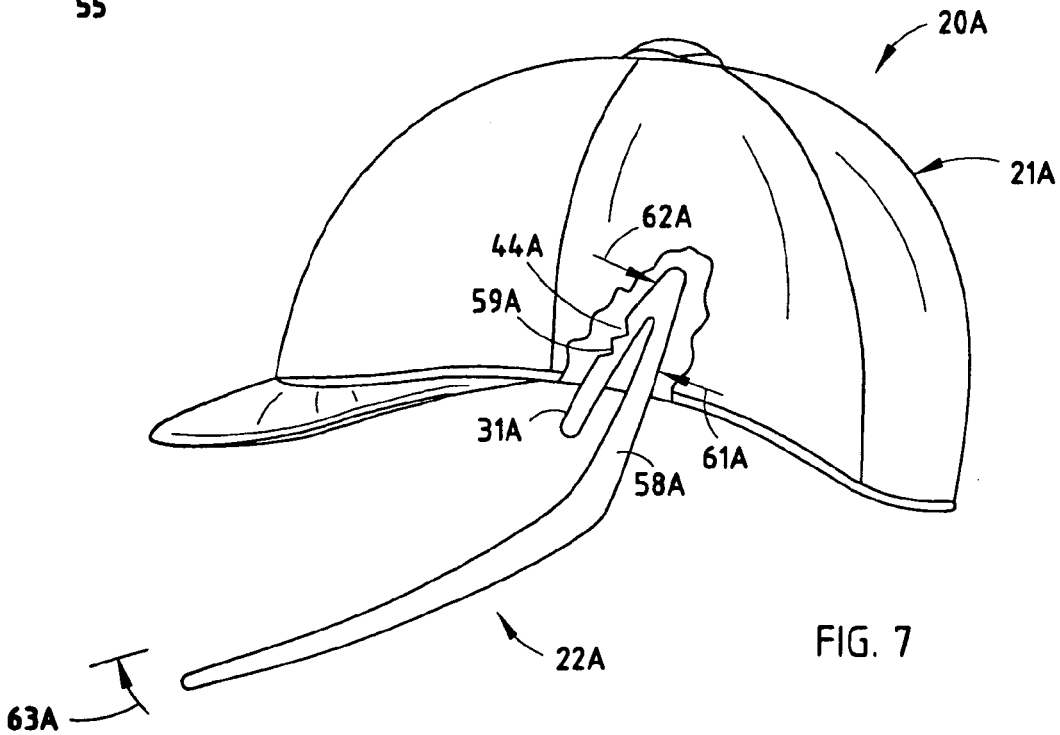
FIGS. 7–9 are side views of additional embodiments, similar to FIG. 1, but with modified latching systems, the helmet shell in each case being partially broken away to better show the latching system.

In an alternative faceguard 22A (FIG. 7), the latching member 31A is moved to a front side of the vertical section 58A which is the reverse of the faceguard 22 (FIG. 3). The teeth 44A (FIG. 7) are positioned on the front surface 42A, and latching tooth(s) 59A are similarly moved to a location on the latching member 31A for engagement with the teeth 44A. Upon impact, the faceguard 22A tends to immediately resist any impacting force by generation of a resisting torque created by forces from the helmet shell 21A indicated at arrows 61A and 62A. At the same time, any impact forces that would tend to force a person's head upward would be dampened by a limited movement 63A of the faceguard 22A as the vertical section 58A moves against the latching member 31A.

Figure 8:
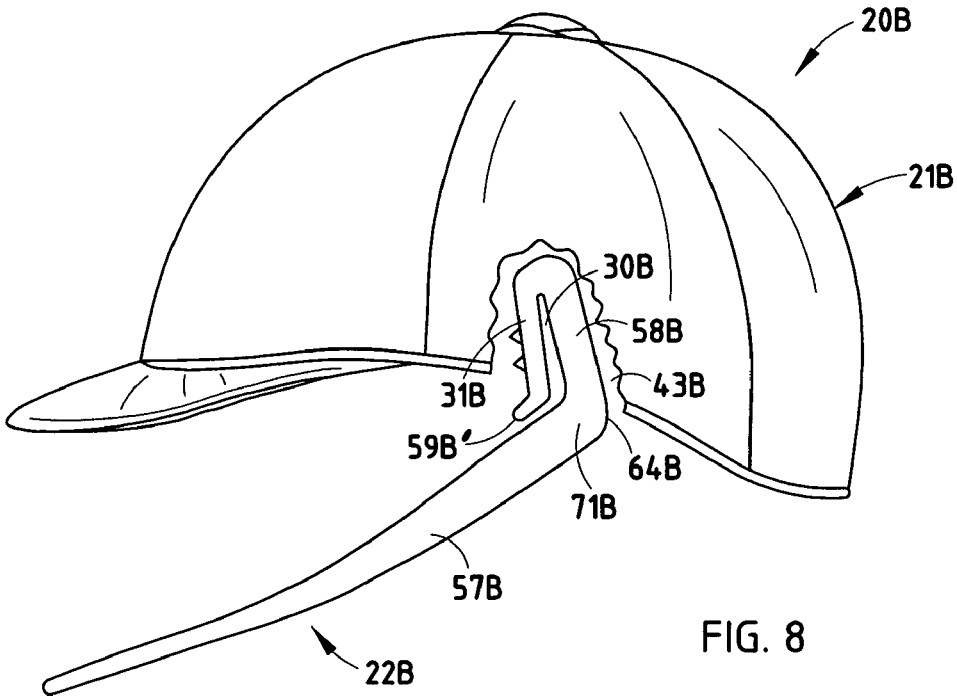

In an alternative faceguard 22B (FIG. 8), the front horizontal section 57B of the faceguard 22B is elongated such that its rear end 64B (i.e. at the joint 71B of the horizontal and vertical sections 57B and 58B) abuts the rear surface 43B of the receptor 30B. Thus, when a front impact occurs such as when a rider's face strikes a horse's neck or head, the force is immediately resisted without movement of the faceguard 22B. Also, the handle 59B' is shaped to create an aesthetic and highly useful arrangement where the rider is able to release the latching member 31B by pinching the handle 59B' to cause the latching member 31B to move to a release position.

Figure 9:
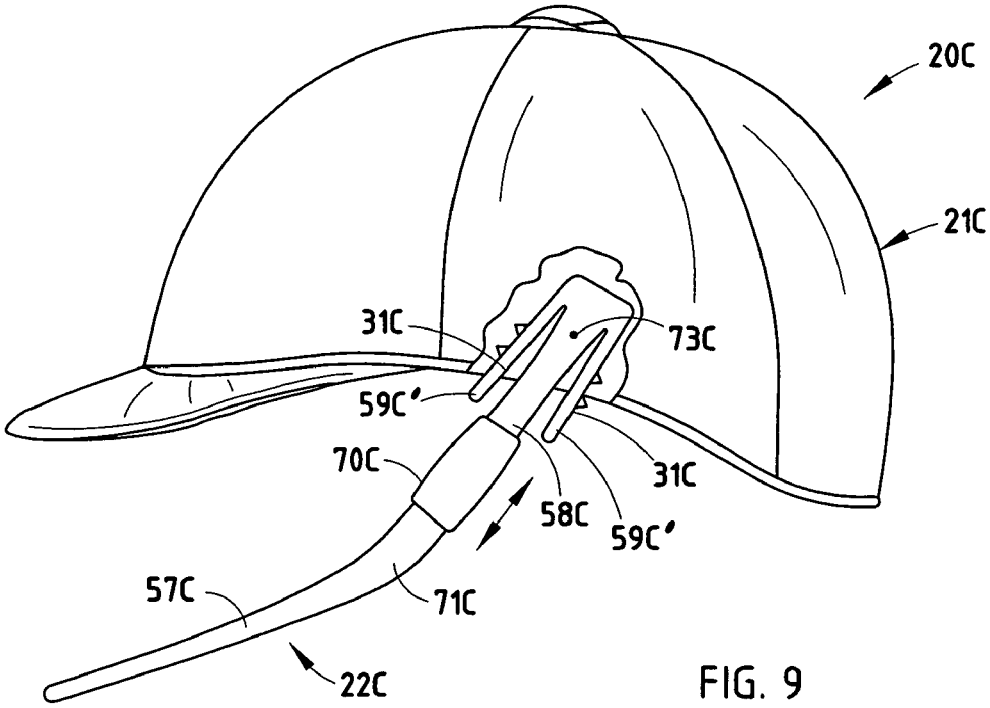

In an alternative faceguard 22C (FIG. 9) a sleeve-like locking member 70C is slidably positioned on the vertical section 58C. The locking member 70C is configured to move into the space between the latching member 31C and the vertical section 58C. A detent formed between the locking member 70C and the vertical section 58C retains the locking member 70C in its locking position until a person pulls down on the locking member 70C. This illustrated faceguard 22C includes front and rear latching members 31C and the illustrated locking member 70C includes front and rear flanges adapted to take up the spaces between the two latching members 31C and the vertical section 58C. By this arrangement, when the locking member 70C is in an up/locked position, the faceguard 22C is rigidly attached to the helmet shell 21C and is not moveable upon impact. Nonetheless, it is noted that some flexing and bending of the faceguard 22C will occur during an impact. For example, in a front impact, the horizontal and vertical sections 57C and 58C will torsionally absorb energy as they bend, particularly at their joint 71C.

Figure 10:
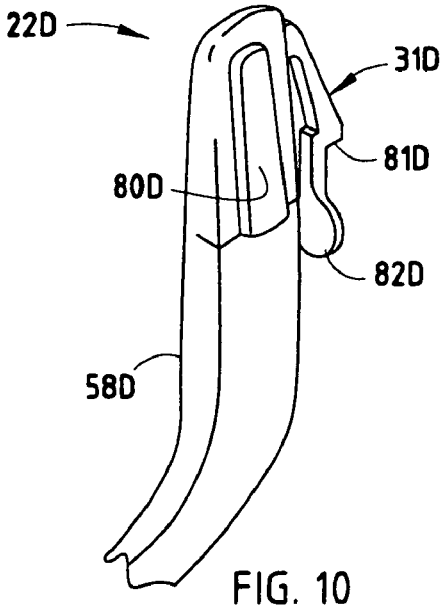
FIG. 10 is a perspective view of an alternative faceguard with a modified latching system.

FIG. 10 discloses a particular faceguard 22D where the tail end of the vertical section 58D includes a protruding guide ramp section 80D on an outboard side surface having a width narrower than the section 58D. The ramp section 80D helps with alignment and stabilization of the blade in the helmet. Also, the latching member 31D is modified to be thinner than the vertical section 58D, and to include a distinctive step 81D that helps to form a positive engagement with the mating step in the receptacle in the helmet and helps to provide the distinctive click noise during positive latching engagement. The lower end of the latching member 31D includes an enlarged tab 82D forming an enlarged surface for receiving a finger when pressing the latching member 31D to release the faceguard 22D. The other side of the faceguard 22D is similarly shaped.

Figure 1:
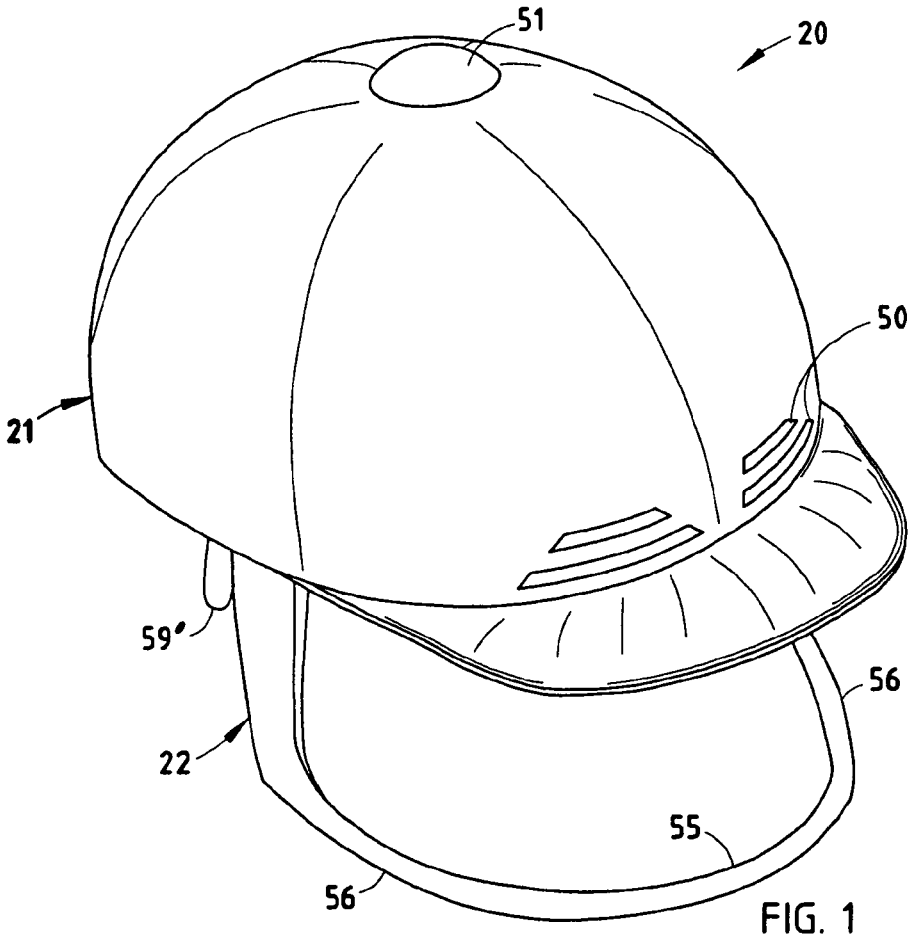
FIGS. 1–2 are perspective and side views of an equestrian helmet embodying the present invention.
Figure 2:
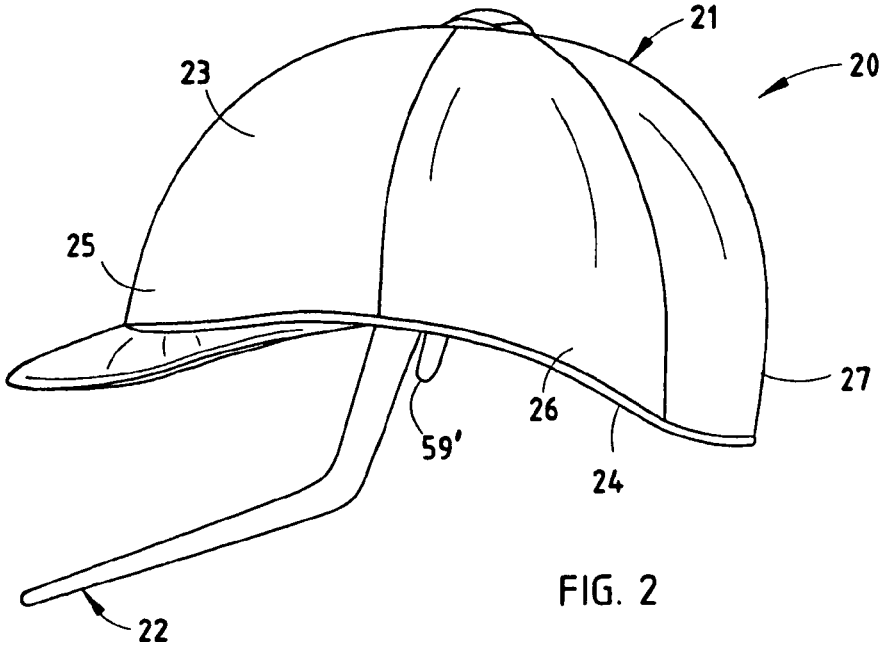
Figure 11:
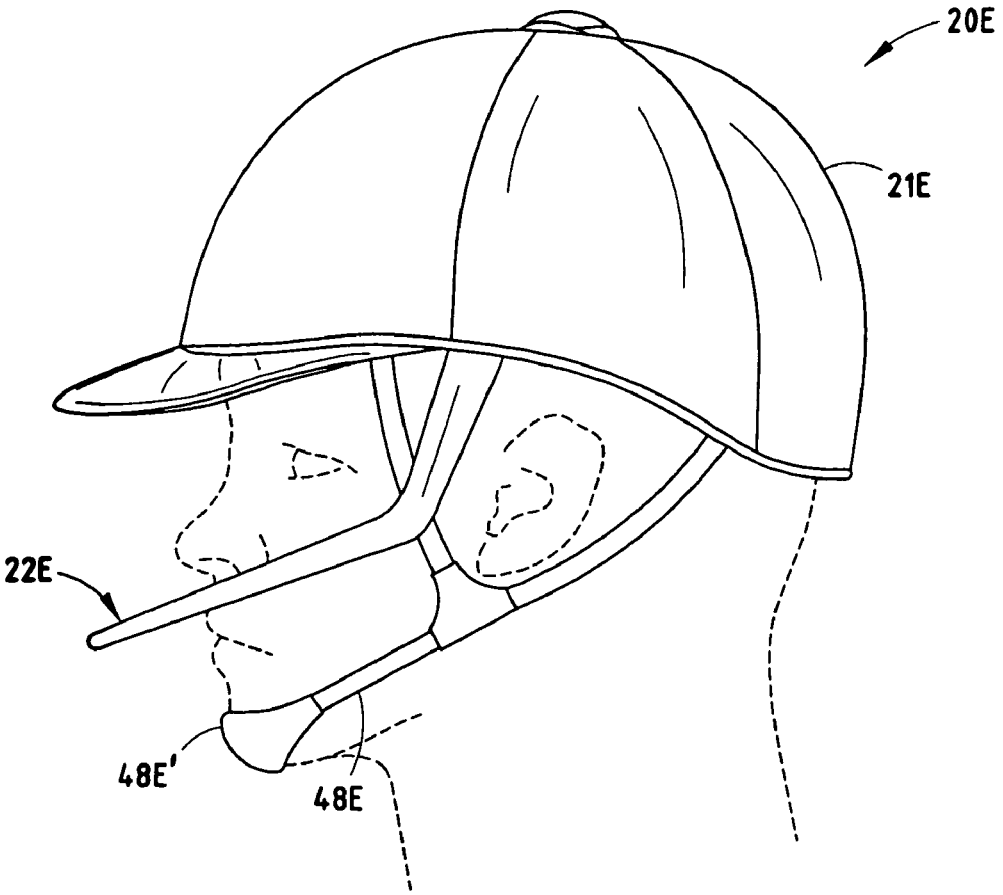
FIG. 11 is a side view of a modified equestrian helmet embodying the present invention.

FIG. 11 discloses a particular helmet 20E having a shell 21E and faceguard 22E similar to that shown in FIG. 1, but with a chin strap 48E with a chin-engaging section 48E'. (Compare FIGS. 3 and 11.)

MODIFICATION

Figure 12:
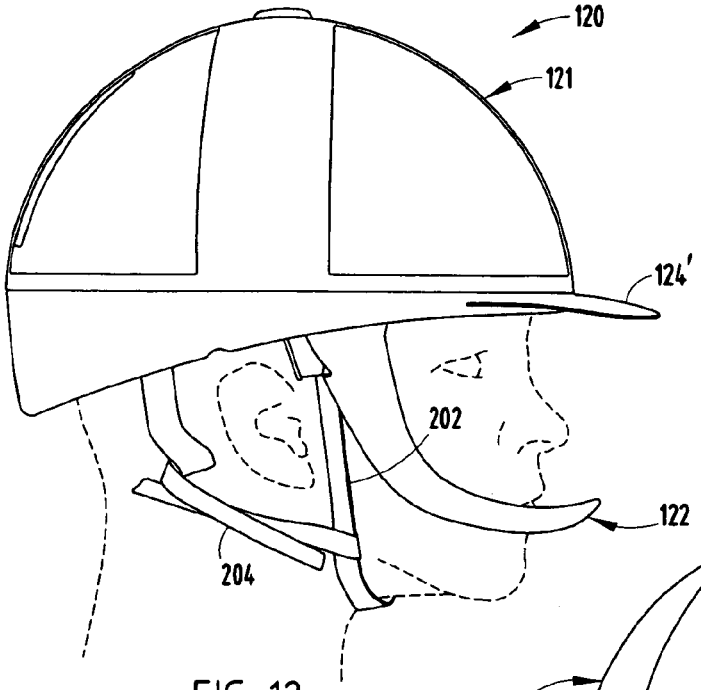
FIG. 12 is a side view of another modified equestrian helmet embodying the present invention.
Figure 13:
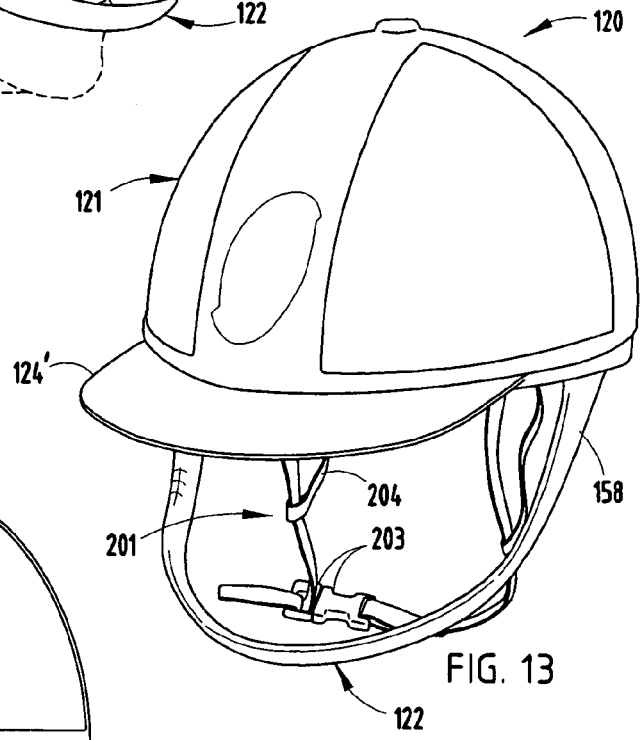
FIGS. 13–17 are perspective, front, rear, top, and bottom views of FIG. 12.
Figure 14:
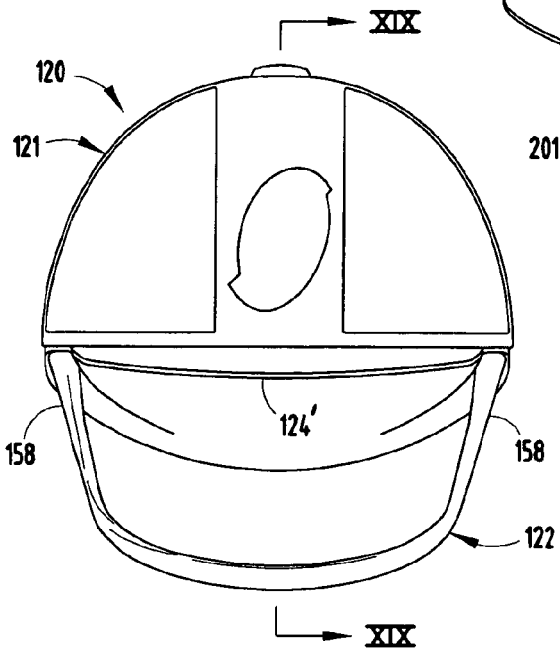
Figure 15:
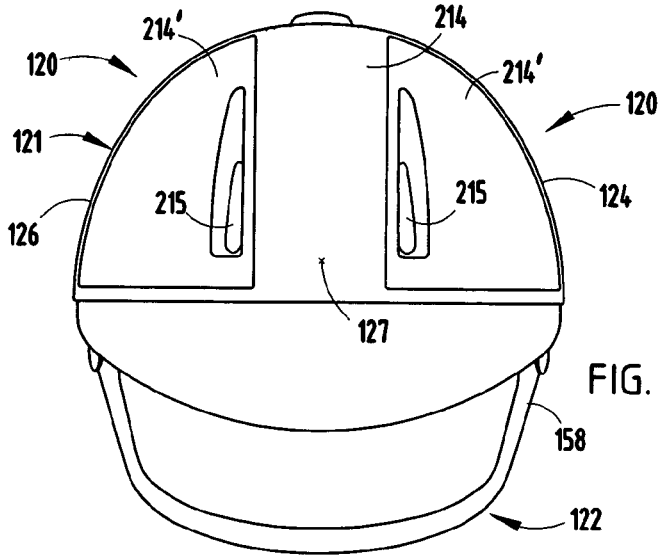
Figure 16:
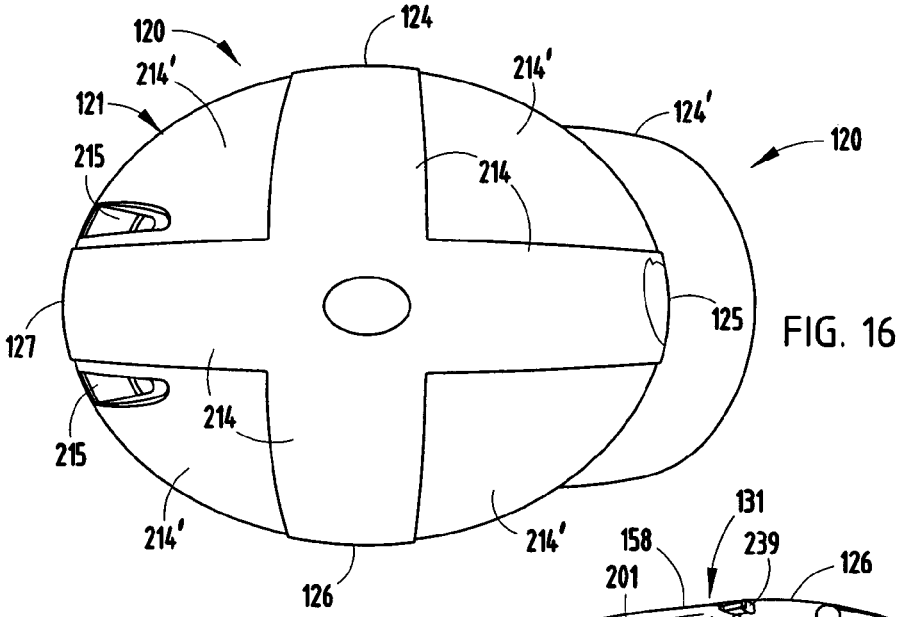
Figure 17:
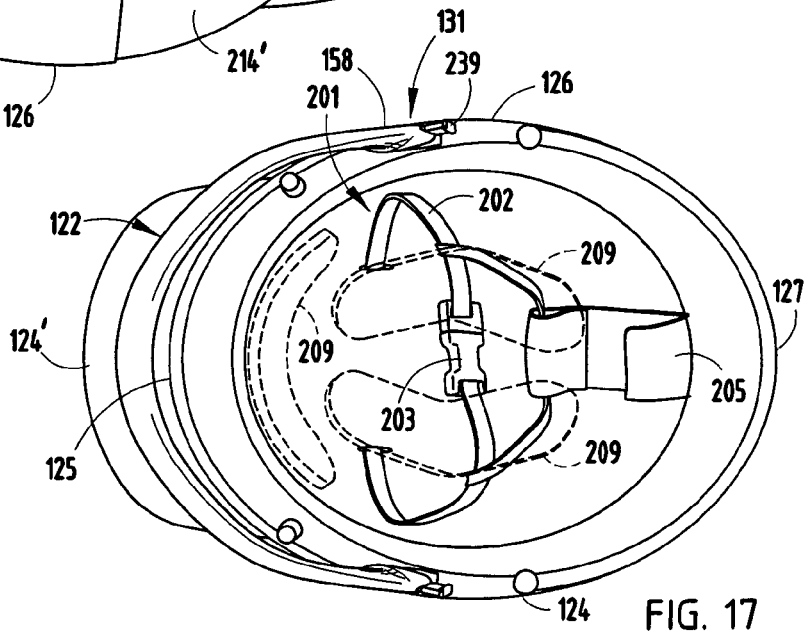

A modified helmet 120 (FIG. 12) is provided that also is particularly adapted for use in equestrian sports. Nonetheless, like the aforementioned helmets, it is contemplated that the helmet 120 is adapted for use in many other sports and situations where protective head gear is desired that allows a wide unobstructed field of view and where its faceguard may want to be easily and quickly removed. In the additional embodiment below, features that are similar or identical are identified using the same numbers as previously discussed but with the addition of 100 to the number. For example, number 120 is used for the helmet (previously referred to as number 20, etc). This is done for the purpose of reducing redundant discussion.

The illustrated helmet 120 (FIG. 12) includes an impact-resistant outer helmet shell 121 and a U-shaped releasably-attached faceguard 122. The shell 121 is formed to cover an upper half and rear neck portion of a wearer's head. The shell 121 (FIG. 18) is two-piece, and includes an upper dome 123 and also has a lower continuous rim 124 extending around the dome 123. The lower rim 124 fits matably against a bottom edge of the dome 123 and is screwed thereto to form a rigid assembly. The separate lower rim 124 facilitates molding into the shell the latching cavities 130 (also called "receptors" herein), the cavities 130 having undercut laterally-extending surfaces designed to be releasably engaged by the latch members 131 on the rearwardly extending portions of the faceguard 122, as discussed below. The attachment cavities 130 open downwardly through the rim 124, such that they are not visible from the sides or the front of the helmet 120, which is an important property of the present helmet 120 as discussed above. In helmet 120, the latch members 131 are separately molded components pivotally attached to and supported on a tail end (or blade portion) of the rear upright section 158. The latch members 131 include a main body biased into engagement with the laterally extending surfaces by an integral spring 235 such that they securely engage the attachment receptors 130 with an audible click. Also, this allows them to be released by a simple pinching motion, allowing the faceguard 122 to be quickly and easily released from the helmet 121 with a smooth easy finger motion. At the same time, this allows the latch members 131 to be made of a material optimized for durability and resiliency, which is preferably of a material different than the faceguard itself.

Figure 18:
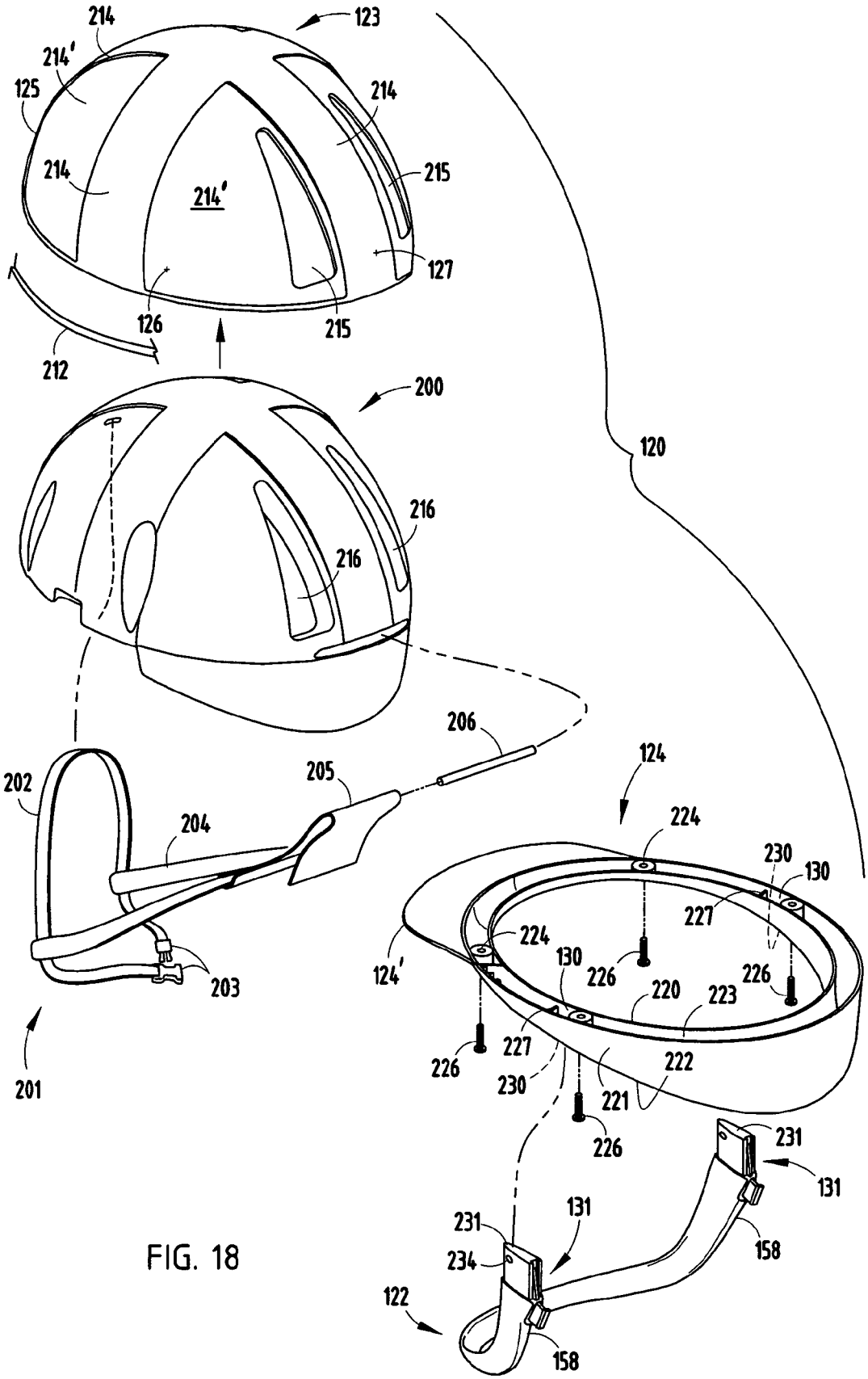
FIG. 18 is an exploded perspective view of FIG. 12.

As illustrated in FIG. 18, a foam shock absorber 200 is positioned within the helmet 120 in a position captured between the upper dome 123 and lower rim 124. A chin strap 201 is secured to the assembly of the helmet 120 and shock absorber 200, and includes first strap sections 202 that extend downwardly from the helmet 120 at position generally forward of a wearer's ears. Releasable clips 203 are provided on ends of the strap sections 202 for engagement proximate a wearer's chin. The strap sections 202 may also include a chin pad if desired. The chin strap 201 also includes a rear strap section 204 that extends from a location above a rear neck area of the wearer, and extends downwardly and around the strap sections 202.

Figure 19:
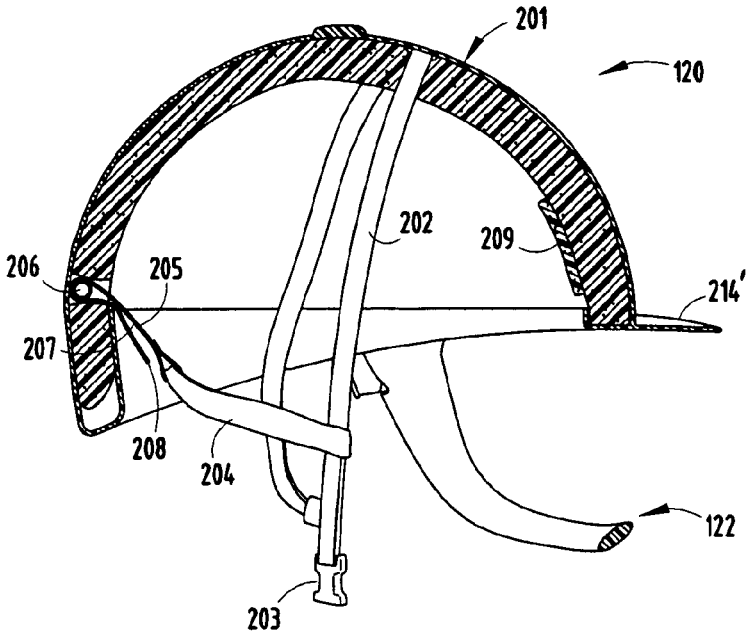
FIG. 19 is a cross-sectional view taken along the line XIX—XIX in FIG. 14.

An adjustable strap 205 (FIG. 18) secures the rear strap section 204 to the assembly of the helmet 120 and shock absorber 200. Specifically, a transverse rod-shaped anchor 206 is positioned in the helmet 120 above the rim 124 and between the shock absorber 200 and the upper dome 123. A cup-shaped or cylindrical bushing is positioned on each end of the anchor 206 to assist in rotation of the anchor and to provide clearance for the strap. The adjustable strap 205 (FIG. 19) extends around the anchor 206 and doubles back on itself at a location where it includes mating patches 207 of hook-and-loop material. The adjustable strap 205 allows adjustment of the chin strap 201 by providing for a length adjustment of the adjustable strap 205 as follows. A person wearing the helmet 120 can pull a terminal end 208 of the adjustable strap 205 free, and then pull downward to shorten the strap (or can then adjust the helmet to cause the strap to lengthen). This causes the chin strap 201 to be lengthened relative to the chin of a person wearing the helmet 120. The chin strap 201 is fixed in the new position by reattaching the patches 207. Notably, when the adjustable strap 205 is pulled, it slidingly rolls around the rod-like anchor 206 with a smooth and relatively easy motion. Also, the rod-like anchor 206 can be supported for slight rotation and/or fore/aft movement when adjustable strap 205 is adjusted. An upper portion of the rim 124 can be configured to securely support the anchor 206 with sufficient stability for the purpose intended. Thus, a unique and user-friendly adjustability is provided with the present helmet 120. Where desired, additional patches 209 are provided on the chin strap 201 and/or on an inside of the shock absorber 200, such as for comfort and/or absorption of sweat.

The shell 121 (FIG. 18) includes a front portion 125, lateral side portions 126, and a rear portion 127, all portions 125–127 having outer surfaces that are relatively smooth, particularly the lateral side portions 126. The reason for this is both aesthetics (i.e., to match the traditional shape of equestrian helmets) and also function (to avoid outward protrusions that can cause safety concerns). Nonetheless, recesses and embossments can be formed into the shell dome 123 for functional reasons and as a complementary shape to the helmet design as noted below.

Figure 25:
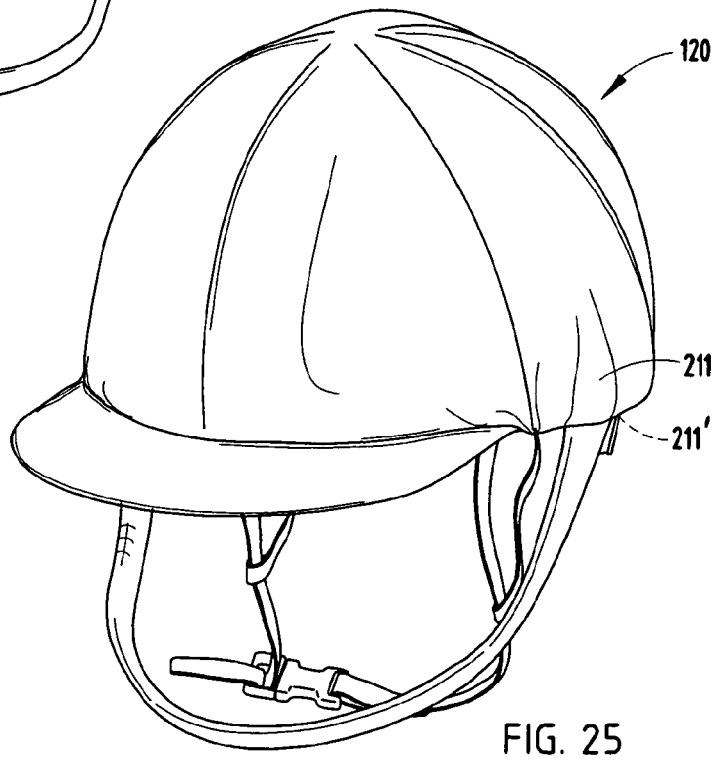
FIG. 25 is a perspective view similar to FIG. 13 but with a fabric outer covering on the helmet.

The shock absorber 200 (FIG. 18) is configured to fit matably upwardly into the concavity of the upper dome 123 and further includes a lower portion shaped to fit matably into a concavity of the lower rim 124. It is contemplated that the assembly of the upper dome 123 and lower rim 124 will create a clean, relatively "perfect" line around the helmet 120. Further, in many cases, the helmet 120 will be covered by a fabric covering 211 (FIG. 25), such that the line will not be visible. Nonetheless, it is noted that an aesthetic tape 212 (FIG. 18) can be used. Where the aesthetic tape 212 is about ¼ inch wide (or wider), the tape 212 doubles as an additional attachment device for securing the dome 123 and rim 124 together. It is noted that the present invention is intended to include securing the dome 123 and rim 124 together in many different ways, such as mechanically (with screws as shown, or with rivets, heat-staked studs, sticky tape spanning the line of joindure, integral structure configured for snap-attachment, etc), chemically (adhesively, material bonding through melting, RF bonding, sonic bonding, insert or over-molding, etc), and/or in combinations of the above.

The upper dome 123 (FIG. 18) is particularly constructed to facilitate molding and later assembly. The upper dome 123 includes an X-shaped arrangement of embossed ribs 214 that extend across the upper dome 123, providing stiffening of the upper dome 123. The ribs 214 form recessed areas 214 that have been found to provide a very attractive "balanced" appearance to the upper dome 123. Upper dome 123 also is configured with apertures 215 that match apertures 216 in the shock absorber 200. The apertures 215 and 216 align to provide for air flow through to a person wearing the helmet 120, which can be important for comfort and to provide cooling air to the wearer's head.

Rim 124 (FIG. 18) as shown forms a continuous ring matching a lower portion of the upper dome 123, and includes a forwardly-extending portion forming a bill 124'.

The illustrated bill 124' is integrally formed with the rim 124. However, it is contemplated that the bill (124') can be made as a separate part and from a softer material. In such circumstance, the bill would include a rear edge clamped between the rim 124 and the dome 123. If desired, the bill could include a ridge that fits into a groove running along the inter-engaging surfaces between the rim 124 and dome 123. The bill could be removed by loosening the screws, removing the bill from between the rim 124 and dome 123, and re-tightening the screws. For example some equestrian covers already have a soft bill on them, and it may be undesirable to have a "second" or duplicative bill on the helmet 120.

More specifically in regard to the illustrated rim, the rim 124 includes spaced apart inner and outer walls 220 and 221 connected by a lower wall 222 to define an upwardly facing cavity 223 adapted to receive a lower edge of the shock absorber 200. An outer surface of the outer wall 220 generally aligns with an outer surface of the upper dome 123 for providing a flush appearance, but can of course include an offset if desired. A plurality of apertured bosses 224 are positioned around the rim 124 in the cavity 223, and are positioned to align with similarly shaped apertured bosses on the upper dome 123. Screws 226 fit through the lower bosses 224 and thread into the aligned apertured bosses in the upper dome 123 to secure the rim 123 to the dome 124. Stiffening ribs 227 extend between the inner and outer walls 220 and 221 for stabilizing the walls 220 and 221. It is noted that the bosses 224 also support the walls 220 and 221 relative to each other.

The stiffening ribs 227 (FIG. 18) are located generally above and a bit behind the wearer's ears at a location where they form part of the attachment cavities 130. It is contemplated that the attachment cavities 130 include an apertured opening or notched surface forming a "blind" surface 229 suitable for latching engagement by latch members 131 on the faceguard 122. The lower wall 222 includes a downwardly-open access opening 230 for the blade ends 231 of the faceguard 122 to fit upwardly into.

Figure 20:
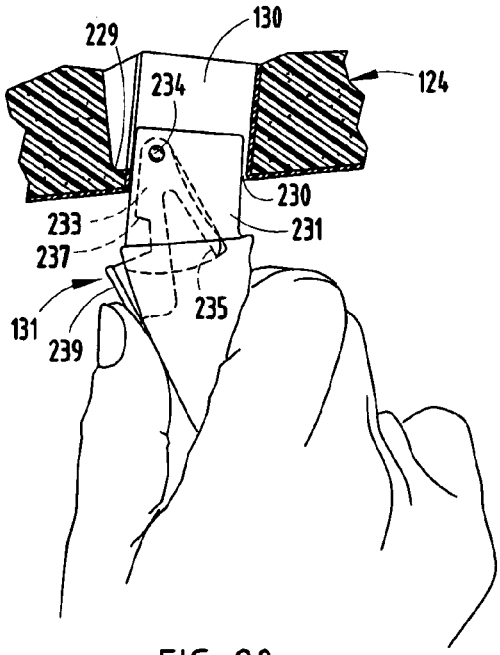
FIGS. 20–21 are fragmentary sectional views of the latching arrangement for the faceguard, the views being partially broken away to show the latching structure, FIG. 20 showing an unlatched position and FIG. 21 showing a latched position.
Figure 21:
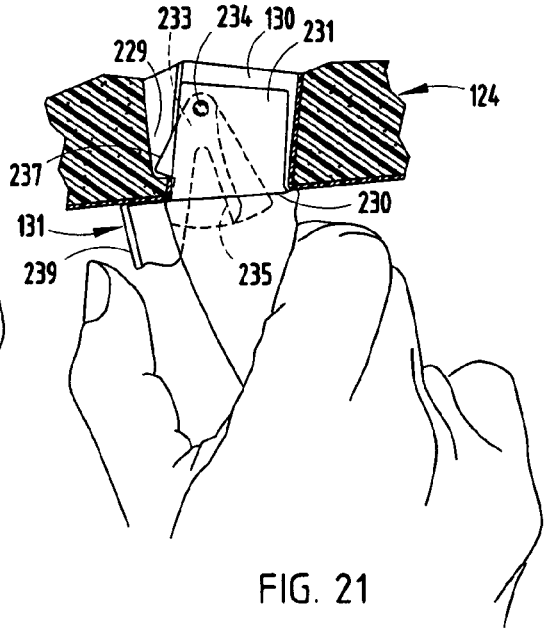
Figure 22:
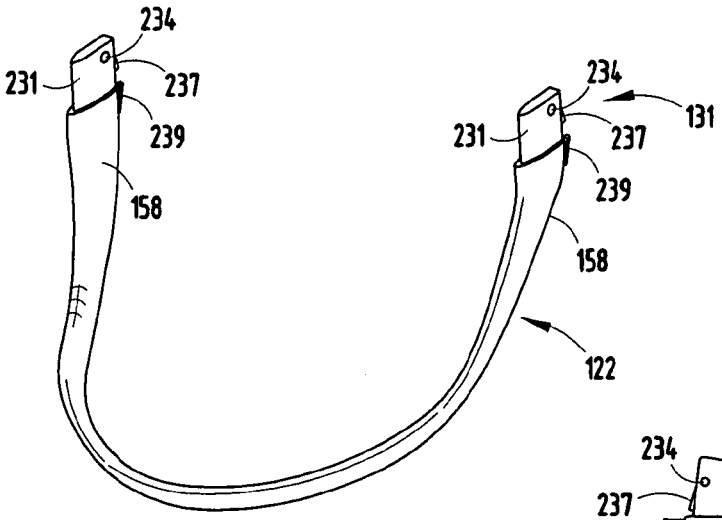
FIGS. 22–24 are perspective, side, and front views of the faceguard.
Figure 23:
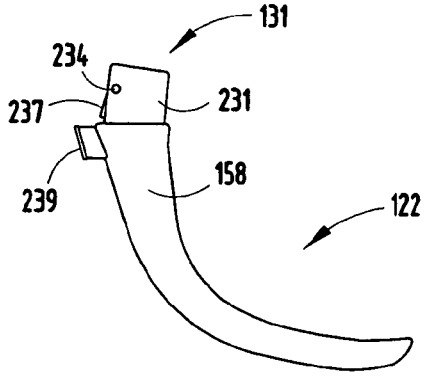
Figure 24:
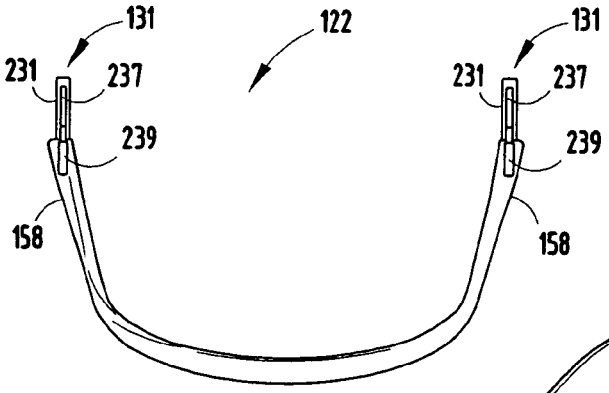

The latching members 131 (FIGS. 20–21) are separately molded plastic components made of a durable resilient material such as nylon. Each latching member 131 includes a body 233 pivoted to the blade end 231 near its upper end by a rivet-like pivot pin 234. An integrally formed leaf spring 235 extends from an upper end of the body 233 at an angle such that it engages the blind surface 229 on the rim 124 to bias the body 233 of the latching member 130 forwardly. A latching ledge 237 is formed in a front of the body 233. The latching ledge 237 is shaped to engage the blind surface 229 formed on the rim 124 when the blade end 231 is fully inserted into the cavity 130, and is biased into engagement by the spring 235. A release tab 239 is formed on the body 233 and is shaped for depressing engagement by a wearer's finger to move the body 233 against a force of the spring 235 into a position where the latching ledge 237 is released from the blind surface 229. The tab 239 extends below the rim 124 for easy access, and is positioned near but spaced slightly from the blade end 231, so that the wearer can, with one hand and with a smooth easy motion, pinch the tab 239 against the blade end 231 and release the latching member(s) 130 on the faceguard 122. A shape of the release tab 239 generally matches and complements a shape of the blade end 231, so that the helmet's aesthetics are maintained.

The fabric covering 211 (FIG. 25) includes a fabric main panel with elastic or cord 211' around its perimeter. Such fabric coverings are well known in the art, such that a detailed description is not required herein. The illustrated covering 211 can be positioned on the helmet 120, with its perimeter and elastic tensioned around the helmet 120 at a location under the rim 124. Alternatively, the perimeter of the covering can be pinched between or secured along the joint line between the dome 123 and rim 124. If desired, retainers can be formed along the joindure of the dome 123 and rim 124 for retaining the covering.

It is also contemplated that the appearance of the designs of the assembly and of the various components individually as illustrated in the various FIGS. 1–25 are novel, ornamental, and unobvious and hence patentable based on their aesthetics.

It is to be understood that variations and modifications can be made on the aforementioned structure without departing from the concepts of the present invention and further it is to be understood that such concepts are intended to be covered by the following claims unless these claims by their language expressly state otherwise.

The embodiment for which a privilege or property right is claimed includes:

1. A protective helmet comprising:

impact-resistant outer helmet shell shaped and adapted to partially cover a wearer's head, the shell having an upper dome with a lower edge and having a separate lower rim with an upper surface that mates against the lower edge, the rim being attached to the upper dome, wherein the rim includes cavity-forming marginal material on each side defining a pair of cavities and further defining a downwardly-open access opening adapted to receive and support an upwardly-extending leg of a faceguard.

2. The helmet defined in claim 1, including a securement securing the rim to the upper dome, the securement including one of mechanical fasteners, latches, adhesive bonding material, melted bonding material, and heat-staked material.

3. The helmet defined in claim 2, wherein the securement includes a mechanical fastener.

4. The helmet defined in claim 3, wherein the mechanical fastener includes a screw.

5. The helmet defined in claim 4, wherein the dome includes an apertured boss aligned with an aperture in the rim for receiving the screw.

6. The helmet defined in claim 1, wherein the dome includes air-flow apertures formed therein to provide for air flow, the apertures being formed in the dome above the rim.

7. The helmet defined in claim 1, including a faceguard having upwardly-extending legs shaped to matably fit into the access opening and be supported in the pair of cavities.

8. The helmet defined in claim 1, wherein the rim includes an outer wall that lies generally flush with an outer surface of the dome, and further includes an inner wall spaced inwardly from the outer wall, and still further includes a lower wall connecting the inner and outer walls to define a space therebetween.

9. The helmet defined in claim 1, wherein the rim includes a bill extending forwardly from the rim and integrally formed with the rim.

10. The helmet defined in claim 1, including a tape extending along a joint line formed at an interface of the dome and rim, the tape covering the joint line and assisting in bonding the dome and rim together.

11. The helmet defined in claim 1, wherein the rim is a one-piece molding.

12. The helmet defined in claim 1, wherein the rim is an injection-molded component formed with top and bottom surfaces not having undercuts, such that the rim can be made from a die that characteristically does not have slides or pulls or moving die components required to form undercuts.

13. The helmet defined in claim 1, including an energy absorber positioned within the dome and an attachment strap attached to the shell and that is adapted to releasably retain the shell to a wearer's head.

14. The helmet defined in claim 1, wherein one of the rim and dome include an integrally formed bill.

15. The helmet defined in claim 1, including a bill with a rear edge attached to one of the rim and dome.

16. A protective helmet comprising:

an impact-resistant outer helmet shell shaped and adapted to partially cover a wearer's head, the shell having an upper dome with a lower edge and having a separate lower rim with an upper surface that mates against the lower edge, the rim being attached to the upper dome;

including an energy absorber positioned within the dome and an attachment strap attached to the shell and that is adapted to releasably retain the shell to a wearer's head; and an anchor attached to the shell, and wherein the attachment strap includes a rear strap section that extends slidably around the anchor and back onto itself, the rear strap section including mating patches of hook-and-loop material that can be released and reattached in an adjusted position with the rear strap section repositioned on the anchor to adjust the attachment strap relative to the shell.

17. A protective helmet comprising:

an impact-resistant outer helmet shell shaped and adapted to partially cover a wearer's head, the shell having an upper dome with a lower edge and having a separate lower rim with an upper surface that mates against the lower edge; and fasteners extending vertically engaging against and attaching the rim to the upper dome.

18. The helmet defined in claim 17, including a faceguard with upwardly-extending legs shaped to attach to the rim.

19. The helmet defined in claim 18, the faceguard including a first connector on each of the legs and at least one of the dome and rim include mating connectors for engaging the first connector to retain the legs to the helmet.

20. The helmet defined in claim 19, wherein the first connector includes a securing device attached to each of the legs.

21. The helmet defined in claim 20, wherein the first connector is made of a material having high durability and spring-back characteristics.

22. The helmet defined in claim 21, wherein the first connector is made of a different material than the faceguard.

23. The helmet defined in claim 19, wherein the faceguard includes a cross bar extending between a lower end of the legs, the cross bar and legs forming a shape adapted to extend downwardly from the lower rim and then forwardly and then across a wearer's head at a height approximating the location of the wearer's chin and cheeks.

24. A protective helmet comprising:

an impact-resistant outer helmet shell shaped and adapted to partially cover a wearer's head, the shell having an upper dome with a lower edge and having a separate lower rim with an upper surface that mates against the lower edge, the rim being attached to the upper dome, including a faceguard with upwardly-extending legs shaped to attach to the rim, the faceguard including a first connector on each of the legs and at least one of the dome and rim include mating connectors for engaging the first connector to retain the legs to the helmet, wherein the mating connector includes an access opening in the rim and also a blind surface formed in the rim adjacent the access opening.

25. The helmet defined in claim 24, wherein the first connector includes a latch member shaped to releasably engage the blind surface.

26. The helmet defined in claim 25, wherein the latch member includes a spring biasing the latch member into engagement with the blind surface.

27. The helmet defined in claim 26, wherein the spring is integrally formed on the latch member.

28. A protective helmet comprising:

an impact-resistant outer helmet shell shaped and adapted to partially cover a wearer's head, the shell having an upper dome with a lower edge and having a separate lower rim with an upper surface that mates against the lower edge, the rim being attached to the upper dome, wherein the rim includes an outer wall that lies generally flush with an outer surface of the dome, and further includes an inner wall spaced inwardly from the outer wall, and still further includes a lower wall connecting the inner and outer walls to define a space therebetween, including a shock absorber positioned within the dome and including at least a portion that fits into the space defined within the rim.

29. A protective helmet comprising:

an impact-resistant outer helmet shell shaped and adapted to partially cover a wearer's head, the shell having an upper dome with a lower edge and having a separate lower curvilinear structural member with an upper surface that mates against the lower edge, and including fasteners extending vertically engaging against and attaching the structural member to the upper dome, the structural member extending at least completely across a rear of the shell and at least about halfway forward on each side of the shell.

30. A protective helmet comprising:

an impact-resistant outer helmet shell shaped and adapted to partially cover a wearer's head, the outer helmet shell having a marginal section of material forming a lower perimeter around the helmet shell and further having a horizontally extending rod retainer extending horizontally and that is spaced above the marginal section of material forming the lower perimeter;

an impact-absorbing foam material positioned within the outer helmet shell and that at least partially covers the rod-shaped retainer; and an adjustable suspension positioned within the helmet shell and adapted to engage the wearer's head for supporting the helmet shell on the wearer's head while the protective helmet is being worn, the suspension having at least one front strap attached to the helmet shell and having an adjustable strap that extends over the rod retainer and then back to a location within the helmet shell that is accessible; the adjustable strap having overlapping mating hook-and-loop patches that can be released and adjusted, whereby the adjustable strap can be released, pulled, and reattached to adjust the suspension.

31. A faceguard for a protective helmet that is useful when attached to the helmet to help protect a person's chin and head from injury, the faceguard comprising:

an elongated curvilinear component having a transverse section and rearwardly-extending side sections in a U-shaped arrangement that is adapted to extend in front of the person's face, the component including attachment legs that extend upwardly from opposing ends of the side sections; and a latch member on each of the opposing ends of the side sections, the latch members each being made of a material different from the component and including hinges attaching the latch members to the opposing ends for movement between a latched position and a latch-released position.

32. The faceguard defined in claim 31, wherein the hinges include a pivot pin pivotally attaching the latch members to the opposing ends of the component.

33. The faceguard defined in claim 31, wherein the latch members each include an integrally formed spring.

* * * * *